US007886703B2

(12) United States Patent
Nakamura

(10) Patent No.: US 7,886,703 B2
(45) Date of Patent: Feb. 15, 2011

(54) VARIABLE VALVE MECHANISM OF INTERNAL COMBUSTION ENGINE

(75) Inventor: Makoto Nakamura, Isehara (JP)

(73) Assignee: Hitachi, Ltd., Tokyo (JP)

( * ) Notice: Subject to any disclaimer, the term of this patent is extended or adjusted under 35 U.S.C. 154(b) by 405 days.

(21) Appl. No.: 12/068,822

(22) Filed: Feb. 12, 2008

(65) Prior Publication Data

US 2008/0210181 A1 Sep. 4, 2008

(30) Foreign Application Priority Data

Feb. 27, 2007 (JP) ..... 2007-046394

(51) Int. Cl.
*F01L 1/34* (2006.01)

(52) U.S. Cl. ..... 123/90.16; 123/90.15; 123/90.17

(58) Field of Classification Search ..... 123/90.15, 123/90.16, 90.17, 90.31
See application file for complete search history.

(56) References Cited

U.S. PATENT DOCUMENTS 7,252,058 B2 8/2007 Tashiro
2006/0207536 A1* 9/2006 Todo et al. ..... 123/90.16
2007/0163524 A1* 7/2007 Muraji et al. ..... 123/90.16

FOREIGN PATENT DOCUMENTS

JP 2004-076621 A 3/2004
JP 2004-301058 A 10/2004
JP 2006-307765 A 11/2006

* cited by examiner

*Primary Examiner*—Zelalem Eshete
(74) *Attorney, Agent, or Firm*—Foley & Lardner LLP

(57) ABSTRACT

When an actuation mechanism fails to operate and thus fails to control a turning of a control shaft of a valve lift varying mechanism, a moving member is enforcedly moved to an intermediate stable position by a biasing force that is produced by combining a first type force that biases the control shaft in a direction to increase a valve lift degree of an engine valve and a second type force that biases the control shaft in a direction to reduce the valve lift degree of the engine valve. The intermediate stable position of the moving member assures an easy engine starting even in a cold engine condition.

14 Claims, 15 Drawing Sheets

100
A
B
1
2
3
4
5
6
13
15
16
17
20
22
23
23b
24
24a
25
27
28
32
33
34a
34b
34c
34d
36
38
38a
40
41
42
43
44
44a
45
46
47
47a
47b
48
50
51
55
56
57
58
61
62
63
64

VARIABLE VALVE MECHANISM OF INTERNAL COMBUSTION ENGINE

BACKGROUND OF THE INVENTION

1. Field of the Invention

The present invention relates in general to variable valve mechanisms of an internal combustion engine, and more particularly to the variable valve mechanisms of a type that induces an open/close operation of engine valves (viz., intake and/or exhaust valves) while varying a valve lift degree and an operation angle of the engine valves in accordance with an operation condition of the engine. More specifically, the present invention is concerned with an actuation mechanism for actuating the variable valve mechanism.

2. Description of the Related Art

Hitherto, various variable valve mechanisms have been proposed and put into practical use in the field of automotive internal combustion engines. One of such mechanisms is the mechanism disclosed in Japanese Laid-open Patent Application (Tokkai) 2004-76621.

That is, the variable valve mechanism of the Laid-open Patent Application generally comprises a drive shaft that is driven by a crankshaft of the engine, two united swing cams for each cylinder that induce an open/close operation of respective intake valves when swung, a drive cam for each cylinder that is tightly disposed on the drive shaft, a transmission mechanism for each cylinder that includes a rocker arm and is arranged between the drive cam and one of the swing cams to transmit movement of the drive cam to the swing cam while converting a rotary motion of the drive cam to a swing motion of the swing cam (or swing cams), a control mechanism that includes an eccentric control cam operatively received in a circular opening of the rocker arm and a control shaft for controlling a rotary motion of the eccentric control cam, and an actuation mechanism that controls a rotary motion of the control shaft in accordance with an operation condition of the engine.

The actuation mechanism comprises an electric motor, a ball screw shaft that is actuated by the electric motor to rotate in normal and reversed directions, a ball nut member that is operatively engaged with the ball screw shaft and axially movable along and on the ball screw shaft when the ball screw shaft is turned, a link member that has a forked end pivotally connected through respective pins to diametrically opposed parts of the ball nut member, and a connecting arm that has one end secured to one end of the control shaft and the other end pivotally connected to the other end of the link member.

The actuation mechanism further comprises first and second stopper pins that restrict the maximum rotary movement of the control shaft in both normal and reversed directions, and first and second coil springs that function to bias, through the ball nut member, to turn the control shaft in a direction to increase or decease the valve lift degree just before the control shaft is stopped by the first and second stopper pins upon stopping of the engine.

Because of employment of the first and second coil springs, even when, with the ball nut member assuming the frontmost or rearmost end position on the ball screw shaft, the electric motor fails to operate, the control shaft is assuredly turned in one direction to and held at a certain angular position that assures a certain valve lift degree of the intake valves. The valve lift degree thus assured facilitates engine starting even in a cold condition.

SUMMARY OF THE INVENTION

However, in the variable valve mechanisms of the type mentioned hereinabove, the first and second coil springs used are relatively short in length. Accordingly, when the ball nut member is moved over a predetermined length that brings about an excessive valve lift degree, that is, moved excessively toward a middle position of the ball screw shaft, one axial end of the ball nut member becomes separated from the leading end of the coil spring that has been compressed by the ball nut member. This separation causes production of undesirable impact noise when thereafter the axial end of the ball nut member is brought into contact with the leading end of the coil spring. Besides this, before and after the contact, the ball nut member is subjected to a marked sudden change in load applied thereto, which deteriorates the precision of turning or controlling the control shaft. Of course, these undesired matters make the control of the valve lift degree by the variable valve mechanism poor.

It is therefore an object of the present invention to provide a variable valve mechanism of an internal combustion engine, which is free of the above-mentioned drawbacks.

That is, according to the present invention, there is provided a variable valve mechanism of an internal combustion engine in which even when an actuation mechanism fails to operate, a ball nut member is assuredly shifted to and stably held at an intermediate position of the ball screw shaft assuring a certain valve lift degree of the engine valves. Thus, improved cold starting of the engine is obtained, which is a so-called fail-safe function. In addition to this, since the leading end of the first biasing member is constantly in contact with the end of the ball nut member, undesired impact noise and undesired sudden change of load of the ball nut member that would be caused by a separation between the leading end of the first biasing member and the end of the ball nut member are suppressed. Accordingly, the control of the valve lift degree by the variable valve mechanism is improved.

In accordance with a first aspect of the present invention, there is provided a variable valve mechanism of an internal combustion engine, which comprises a valve lift varying mechanism that varies a valve lift degree of an engine valve in accordance with a turning of a control shaft; and an actuation mechanism that controls the turning of the control shaft in accordance with an operation condition of the engine, wherein the actuation mechanism comprises an externally threaded output shaft; an internally threaded moving member operatively engaged with the output shaft and moved axially when the output shaft is turned about an axis thereof; a link mechanism that converts the axial motion of the moving member to the rotary motion of the control shaft; a first stopper structure that stops the axial movement of the moving member when the moving member moves to a first maximum stop position in a first direction to increase the valve lift degree; a second stopper structure that stops the axial movement of the moving member when the moving member moves to a second maximum stop position in a second direction to reduce the valve lift degree; and a first biasing member that constantly biases the moving member in the first direction, wherein when the actuation mechanism fails to operate and thus fails to control turning of the control shaft, the moving member is moved to and held at an intermediate position between the first and second maximum stop positions by a biasing force that is produced by combining the biasing force of the first biasing member and a load that is applied to the control shaft in a direction to reduce the valve lift degree.

In accordance with a second aspect of the present invention, there is provided a variable valve mechanism of an internal combustion engine, which comprises a valve lift varying mechanism that varies a valve lift degree of an engine valve in accordance with a turning of a control shaft; an actuation mechanism that controls the turning of the control shaft in accordance with an operation condition of the engine; a first stopper structure that stops turning of the control shaft when the control shaft turns to a first maximum stop position in a first direction to increase the valve lift degree; a second stopper structure that stops turning of the control shaft when the control shaft turns to a second maximum stop position in a second direction to reduce the valve lift degree; and a first biasing member that constantly biases the control shaft in the first direction, wherein when the actuation mechanism fails to operate and thus fails to control turning of the control shaft, the control shaft is turned to and held at an intermediate angular position between the first and second maximum stop positions by a biasing force that is produced by combining the biasing force of the first biasing member and a load that is applied to the control shaft in a direction to reduce the valve lift degree.

In accordance with a third aspect of the present invention, there is a provided an actuation mechanism for use with a valve lift varying mechanism of a variable valve mechanism of an internal combustion engine, the valve lift varying mechanism varying a valve lift degree of an engine valve when, in accordance with an operation condition of the engine, a control shaft is turned between a first stop position that stops a further turning of the control shaft in a direction to increase the valve lift degree and a second stop position that stops a further turning of the control shaft in a direction to reduce the valve lift degree, the actuating mechanism comprising a first biasing member that constantly biases the control shaft in a direction to increase the valve lift degree; and a second biasing member that constantly biases the control shaft in a direction to reduce the valve lift degree, wherein, upon starting of the engine, the control shaft is turned to and held at an intermediate angular position between maximum and minimum valve lift degree inducing angular positions by a biasing force that is produced by combining the biasing force of the first biasing member, a load applied to the control shaft in a direction to reduce the valve lift degree and the biasing force of the second biasing member.

BRIEF DESCRIPTION OF THE DRAWINGS

Other objects and advantages of the present invention will become apparent from the following description when taken in conjunction with the accompanying drawings, in which:

FIGS. 6A and 6B are views taken from the direction of an arrow "A" of FIG. 1, in which FIG. 6A shows a valve closing operation under a minimum valve lift control and FIG. 6B shows a valve opening operation under the minimum valve lift control;

FIGS. 7A and 7B are views similar FIGS. 6A and 6B, in which FIG. 7A shows a valve closing operation under a maximum valve lift control and FIG. 7B shows a valve opening operation under the maximum valve lift control;

DETAILED DESCRIPTION OF THE EMBODIMENTS

In the following, three embodiments 100, 200 and 300 of the present invention will be described in detail with reference to the accompanying drawings.

Throughout the description, substantially same parts and portions are denoted by the same numerals and repeated explanation of the same parts and portions will be omitted.

Furthermore, in the following, for ease of understanding, various directional terms such as right, left, upper, lower, rightward and the like are used. But, such terms are to be understood with respect to only a drawing or drawings on which the corresponding part or portion is shown.

Furthermore, for ease of understanding, the following description on the present invention is directed to a variable valve mechanism that is practically applied to a V-type 6 cylinder internal combustion engine for variably controlling intake valves of the engine. The drawings, especially FIG. 1, are shown so as to be applied to one bank of the engine that has three in-line cylinders.

Figure 1:
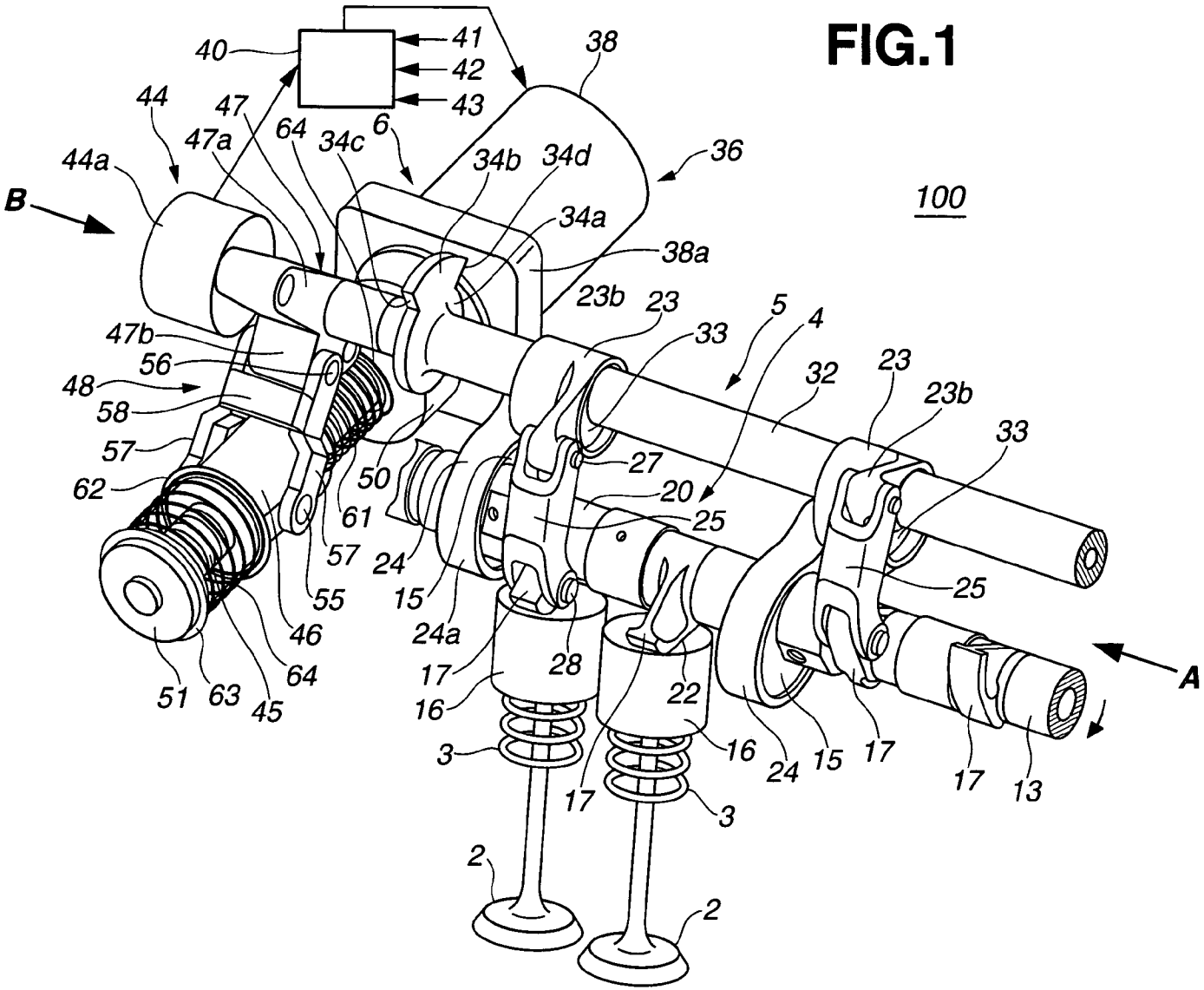
FIG. 1 is a perspective view of a variable valve mechanism of a first embodiment of the present invention.

Referring to FIG. 1, there is shown a variable valve mechanism 100 that is the first embodiment of the present invention.

The variable valve mechanism 100 comprises two intake valves 2 and 2 that are each slidably held at a stem part thereof by a valve guide (not shown) set in a cylinder head 1 (see FIG. 2) of the engine, valve springs 3 and 3 that are applied to intake valves 2 and 2 to bias the same in a close direction, a valve lift varying mechanism 4 that variably controls a valve lift degree of intake valves 2 and 2, a control mechanism 5 that controls operation of valve lift varying mechanism 4 and an actuation mechanism 6 that actuates control mechanism 5.

Valve lift varying mechanism 4 comprises a hollow drive shaft 13 that is rotatably supported by bearing blocks 14 (see FIG. 6A) mounted on cylinder head 1, an eccentric drive cam 15 for each cylinder that is tightly disposed on drive shaft 13, two swing cams 17 and 17 for each cylinder that are united and swingably disposed on drive shaft 13 to repeatedly press down upper surfaces of valve lifters 16 and 16 mounted on top ends of stem parts of intake valves 2 and 2, and a transmission mechanism that is arranged between drive cam 15 and one of swing cams 17 and 17 to transmit movement of drive cam 15 to the swing cam 17 while converting a rotation motion to a swing motion.

Drive shaft 13 is arranged to extend longitudinally in a fore-and-after direction of the engine and rotated by a crankshaft of the engine through a known transmission device. For example, the transmission device is of a type that comprises a sprocket mounted on drive shaft 13 and a timing chain that is put around the sprocket and another sprocket mounted on the crankshaft. Under normal operation of the engine, drive shaft 13 is rotated in a clockwise direction in FIG. 1, that is, the direction indicated by an arrow.

Figure 6A:
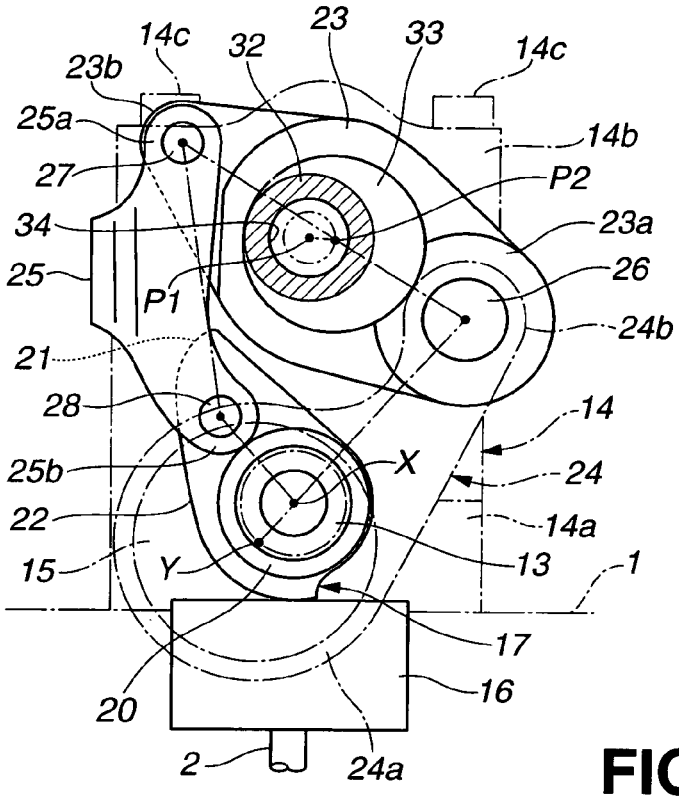

As is seen from FIG. 6A, each bearing block 14 comprises a main bracket 14*a* that is mounted on an upper part of cylinder head 1 to rotatably support drive shaft 13 and a sub bracket 14*b* that is mounted on main bracket 14*a* to rotatably support an after-mentioned control shaft 32. The two brackets 14*a* and 14*b* are united by two bolts 14*c* and 14*c* and tightly mounted to cylinder head 1 by the same bolts 14*c* and 14*c*.

Eccentric drive cam 15 is shaped like a ring and comprises an annular cam portion and a cylindrical portion that is integrally mounted on the annular cam portion. Drive cam 15 has a circular opening through which drive shaft 13 is tightly disposed to rotate therewith like a unit.

As is seen from FIG. 6A, a center "Y" of the annular cam portion of drive cam 15 is offset from an axis "X" of drive shaft 13 by a given degree.

Referring back to FIG. 1, as is mentioned hereinabove, the two swing cams 17 and 17 are united to move like a single unit. That is, two swing cams 17 and 17 are substantially same in shape and integrally formed on axially opposed ends of a cylindrical cam shaft 20. Each swing cam 17 has a raindrop shape. As shown in this drawing, cylindrical cam shaft 20 is rotatably disposed on drive shaft 13.

As is understood from FIG. 1, the left swing cam 17 is formed at a cam nose part 21 (see FIG. 6A) thereof with a pin bore through which a pin 28 passes for an after-mentioned purpose. Cam nose parts 21 of the two swing cams 17 and 17 have each a lower cam surface 22.

As is seen from FIG. 6A, each swing cam 17 has a cam surface 22 that comprises a rounded base surface that is provided near cam shaft 20, a ramp surface that extends roundly from the rounded base surface toward cam nose part 21 and a lift surface that extends roundly from the ramp surface to a maximum lift top surface provided on a leading end of cam nose part 21.

As will become apparent as the description proceeds and as will be understood from FIG. 1, in accordance with a swing movement of each swing cam 17, the rounded base surface, ramp surface and lift surface are brought into contact with a predetermined position of the upper surface of the corresponding valve lifter 16 one after another.

As is seen from FIG. 1, the transmission mechanism comprises a rocker arm 23 that is positioned above drive shaft 13, a link arm 24 that pivotally connects one end portion 23*a* (see FIG. 6A) of rocker arm 23 to drive cam 15, and a link rod 25 that pivotally connects the other end portion 23*b* of rocker arm 23 to swing cam 17.

As is seen from FIGS. 1 and 6A, rocker arm 23 has at a cylindrical base part thereof a supporting circular opening that is rotatably received on an after-mentioned control cam 33. As is seen from FIG. 6A, the end portion 23*a* of rocker arm 23 is radially outwardly projected from the cylindrical base part and has a pin hole for receiving a pin 26. While, the other end portion 23*b* is projected in an opposite direction from the cylindrical base part and has a pin hole for receiving a pin 27. As shown, pin 27 is used for pivotally connecting the other end portion 23*b* with an upper forked end of link rod 25.

As is seen from FIGS. 1 and 6A, link arm 24 comprises a larger diameter cylindrical base part 24*a* and a projected part 24*b* that extends radially outward from base part 24*a*. Cylindrical base part 24*a* is formed at a center area thereof with a larger circular opening 24*c* in which the above-mentioned drive cam 15 is operatively or rotatably received. While, as is seen from FIG. 6A, projected part 24*b* is formed with a pin hole for receiving the above-mentioned pin 26.

As is seen from FIG. 1, link rod 25 is constructed of a channel metal member and postured to face the channel thereof toward rocker arm 23. As is seen from FIG. 6A, link rod 25 is gently L-curved. Upper and lower forked ends 25*a* and 25*b* of link rod 25 are formed with respective pin holes for receiving the above-mentioned pins 27 and 28. That is, pin 27 functions to pivotally connect the other end portion 23*b* of rocker arm 23 with upper forked end 25*a*, while pin 28 functions to pivotally connect cam nose part 21 of swing cam 17 with lower forked end 25*b*, as is well understood from FIG. 1.

Although not well shown in the drawings, each of pins 26, 27 and 28 is provided at one end thereof with a snap ring for restricting axial movement of link arm 24 or link rod 25.

As is seen from FIG. 1, control mechanism 5 comprises a control shaft 32 that is positioned above drive shaft 13 and rotatably supported by bearing blocks 14 and a control cam 33 that is eccentrically and tightly mounted on control shaft 32 and slidably received in the supporting circular opening of rocker arm 23. That is, control cam 33 serves as a swing fulcrum of rocker arm 23.

As shown in FIG. 1, control shaft 32 extends in parallel with drive shaft 13 and has spaced journal portions that are rotatably received between main and sub brackets 14*a* and 14*b* of bearing blocks 14. Furthermore, as will become apparent hereinafter, control shaft 32 is controlled to rotate in normal and reversed directions by actuation mechanism 6.

Control cam 33 is in the form of a cylinder and has a center "P2" that is offset from an axis "P1" of control shaft 32 by a given degree.

As will be described in detail in the following, by a stopper means, control shaft 32 is suppressed from making excessive rotation in normal and reversed directions.

Figure 2:
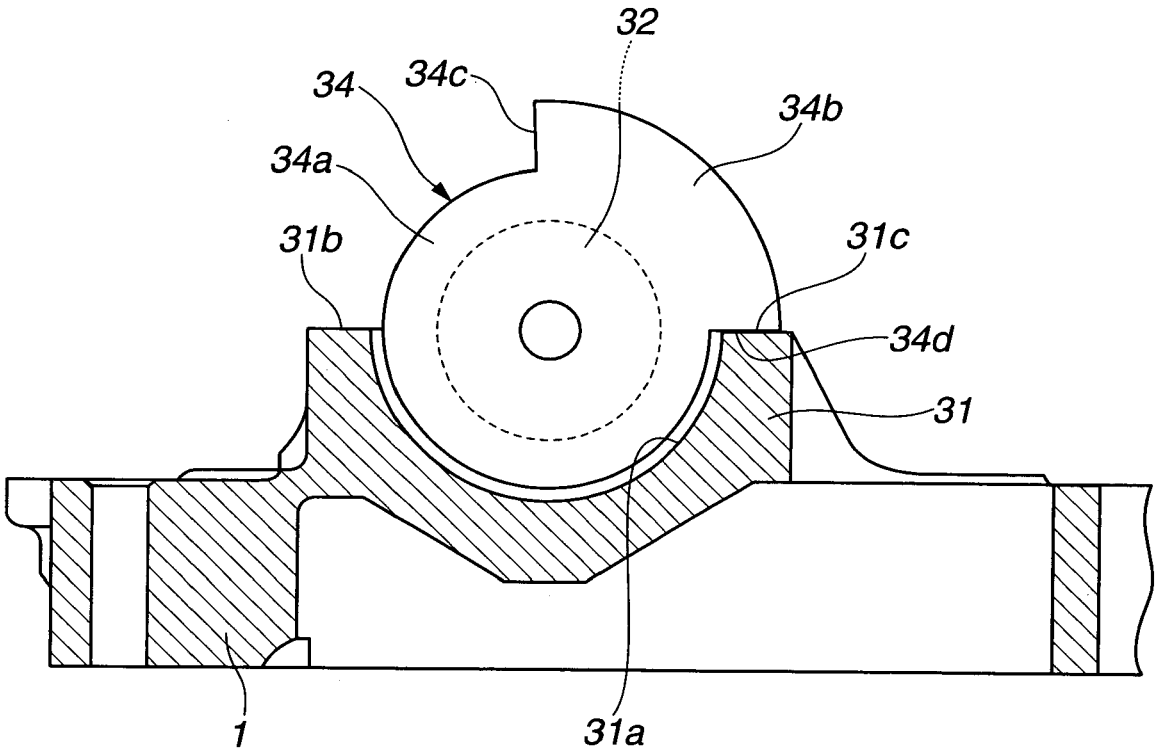
FIG. 2 is an enlarged view taken from the direction of an arrow "B" of FIG. 1, showing a stopper mechanism employed in the first embodiment.

That is, as is seen from FIG. 2 (that is an enlarged view taken from the direction of arrow "B" in FIG. 1), the stopper means generally comprises a stopper wall 31 that is integrally formed on a top of cylinder head 1 of the engine and a stopper member 34 that is secured to an outer surface of control shaft 32.

As shown, stopper wall 31 is formed at a top portion thereof with a semi-cylindrical groove 31*a* and at diametrically opposed portions of the groove 31*a* with first and second stopper faces 31*b* and 31*c*.

While, stopper member 34 comprises a circular base portion 34*a* that is received in semi-cylindrical groove 31*a* of stopper wall-31 keeping a certain but small clearance therebetween and a fan-shaped stopper portion 34*b* that is projected radially outward from a given part of circular base portion 34*a*.

As is well shown in FIG. 2, fan-shaped stopper portion 34*b* has first and second stopper surfaces 34*c* and 34*d* at circumferentially opposed ends thereof, which are able to abut on first and second stopper faces 31*b* and 31*c* of stopper wall 31 respectively upon rotation of control shaft 32 in normal and reversed directions.

That is, when first stopper surface 34*c* abuts on first stopper face 31*b*, control shaft 32 assumes a position to induce the maximum valve lift degree, and when second stopper surface 34*d* abuts on second stopper face 31*c* as shown in the drawing, control shaft 32 assumes a position to induce the minimum valve lift degree. In other words, due to the work of the stopper means, control shaft 32 is forced to rotate or swing by an angle that is smaller than or equal to an angle defined between the maximum and minimum valve lift positions.

As is understood from FIGS. 1, 3, 4 and 5, actuation mechanism 6 comprises a housing 35 that is mounted on a rear end portion of cylinder head 1, an electric motor 36 that is connected to one end of housing 35, and a ball screw type transmission mechanism 37 that is mounted in housing 35 for transmitting a rotation motion of electric motor 36 to control shaft 32 while reducing the rotation speed.

Figure 3:
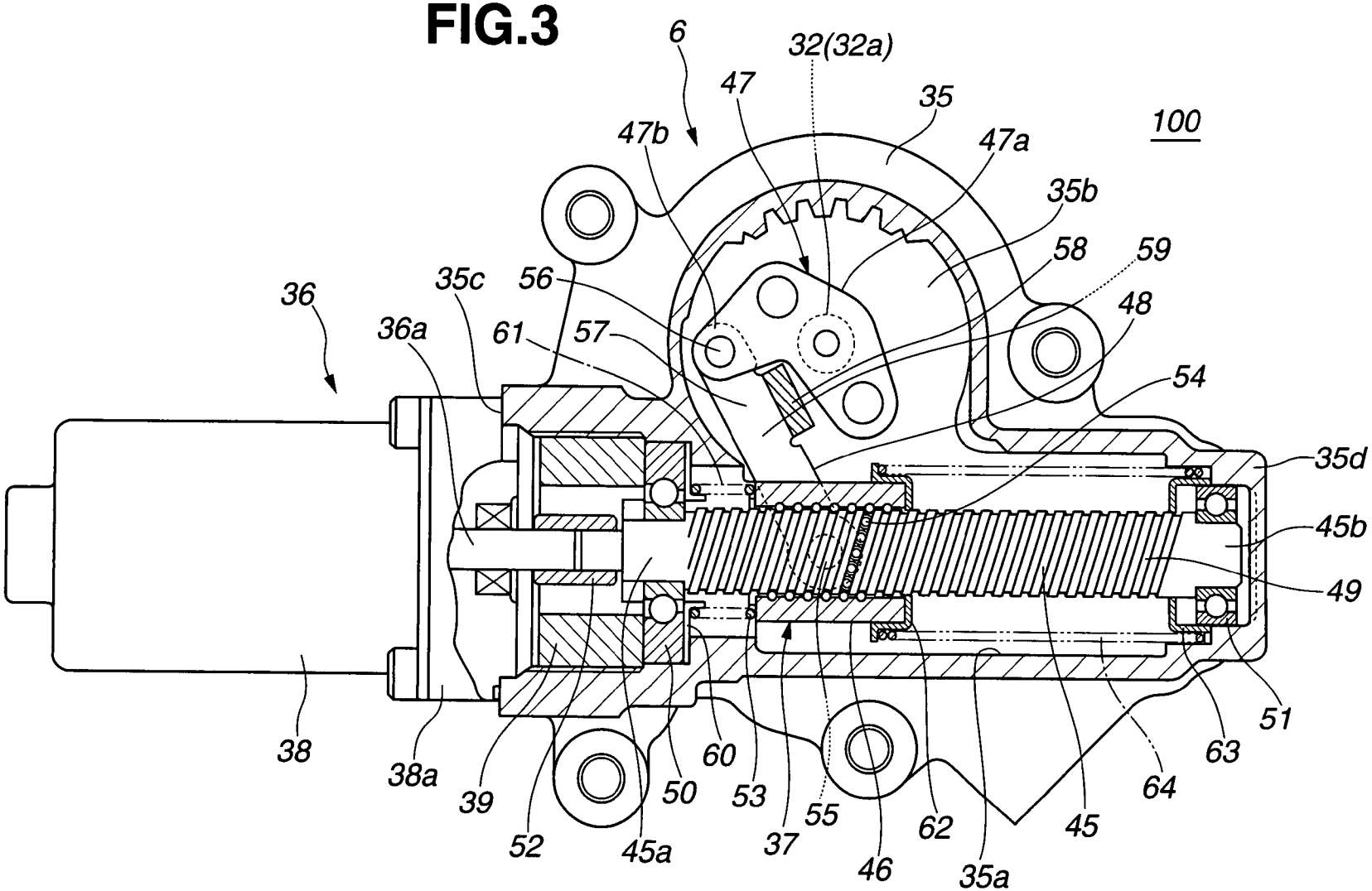
FIG. 3 is a partially cut view of an actuation mechanism employed in the first embodiment, showing that the actuation mechanism assumes a position to induce a minimum valve lift degree.
Figure 4:
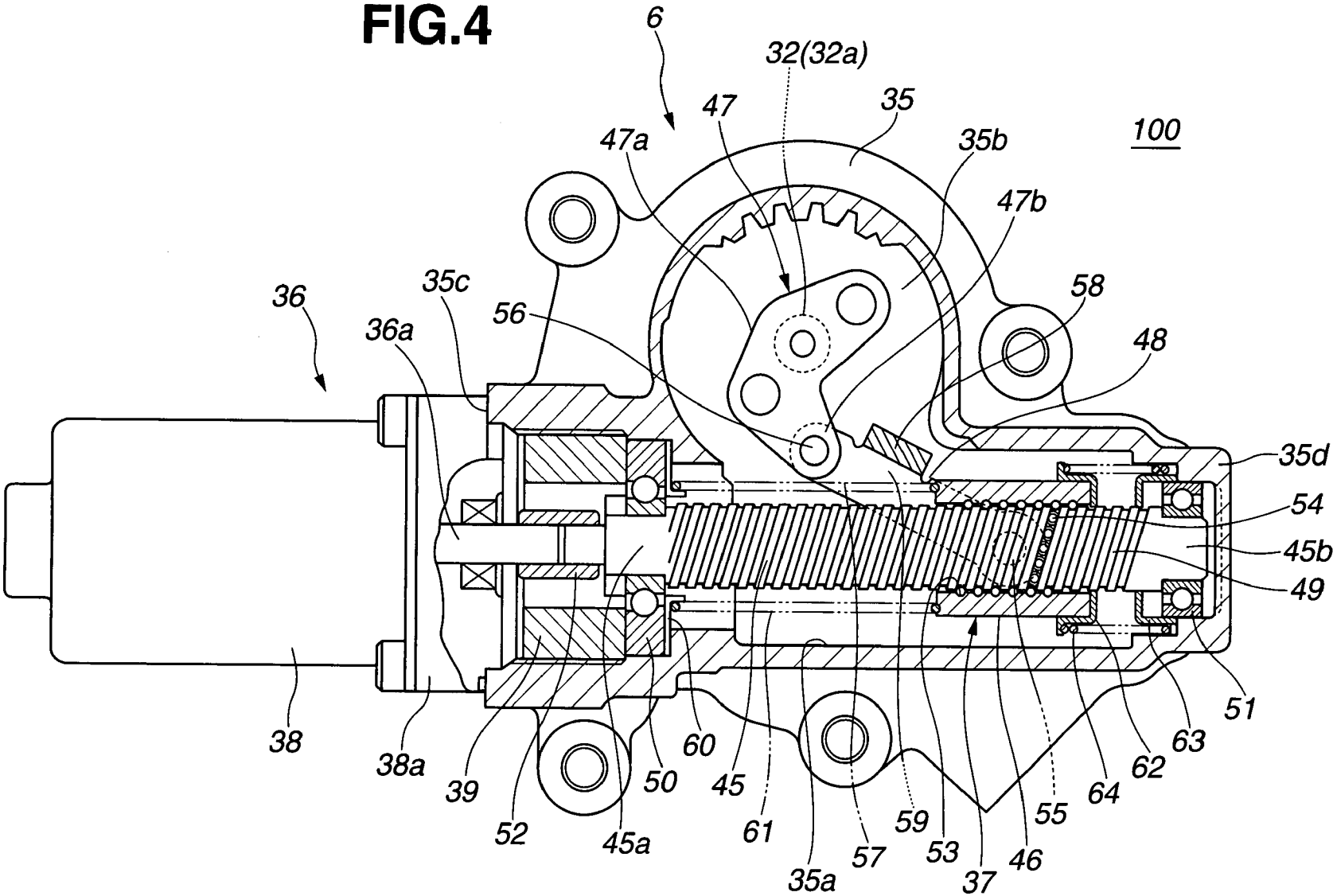
FIG. 4 is a view similar to FIG. 3, but showing that the actuation mechanism assumes a position to induce a maximum valve lift degree.
Figure 5:
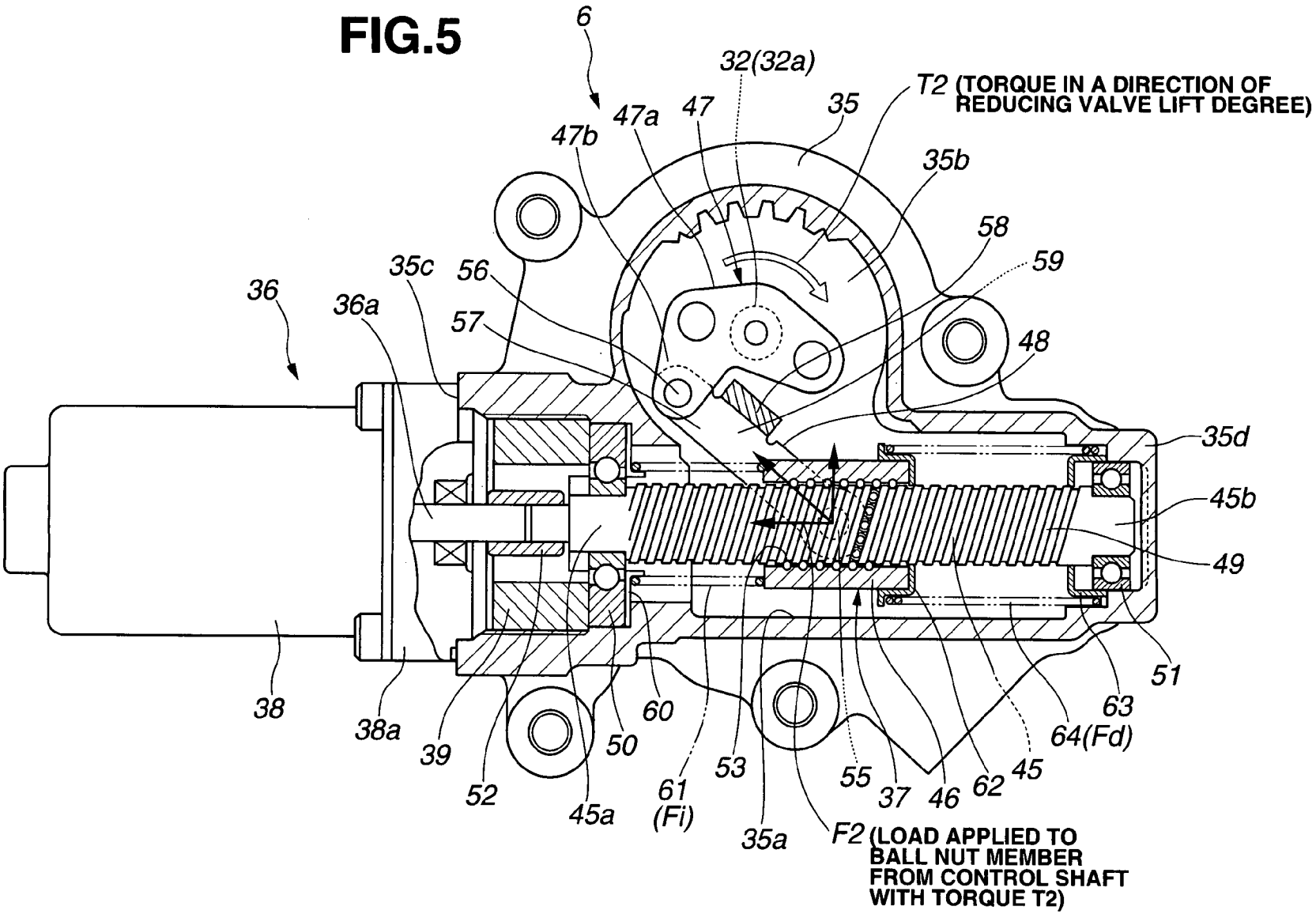
FIG. 5 is a view similar to FIG. 3, but showing that a ball nut member of the actuation mechanism assumes a middle position.

It is to be noted that FIGS. 3 to 5 are views or rear views that are taken from the direction of arrow "B" of FIG. 1.

Housing 35 is made of a metal such as aluminum alloy or the like and has therein an elongate receiving space 35*a* that extends perpendicular to the axis of control shaft 32, as is seen from FIGS. 1 and 3. As is seen from FIG. 3, ball screw type transmission mechanism 37 is received in elongate receiving space 35*a*. Housing 35 has further an expanded upper space 35*b* merged with elongate receiving space 35*a*. An end 32*a* of control shaft 32 is exposed to expanded upper space 35*b*.

As is seen from FIG. 3, elongate receiving space 35*a* is formed at a left end thereof with a circular opening 35*c* and at a right end thereof with a closed end 35*d*.

Electric motor 36 is of a proportional type and has a cylindrical motor casing 38. As shown, a leading end 38*a* of motor casing 38 is secured to housing 35 in a manner to close circular opening 35*c* of elongate receiving space 35*a*.

As is understood from FIG. 1, electric motor 36 is controlled by a control unit 40 that detects an operation condition of the engine. That is, electric motor 36 is controlled or actuated by a control current issued from control unit 40.

By processing information signals from a crank angle sensor 41, an air flow meter 42, an engine cooling water temperature sensor 43 and a control shaft angle sensor (or potentiometer) 44, control unit 40 calculates a current engine operation condition. A feedback control is employed for the calculation of the current engine operation condition.

Referring back to FIG. 3, ball screw type transmission mechanism 37 comprises a ball screw shaft (or output shaft) 45 that is entirely received in elongate receiving space 35*a* of housing 35 in a manner to be coaxial with a drive shaft 36*a* of electric motor 36, a ball nut member (or internally threaded moving member) 46 that is operatively disposed about ball screw shaft 45, an L-shaped connecting arm 47 that is received in expanded upper space 35*b* and secured to end 32*a* of control shaft 32 to rotate together and a link member 48 that links connecting arm 47 and ball nut member 46.

Ball screw shaft 45 is formed at a cylindrical outer surface thereof except axial both end portions 45*a* and 45*b* thereof with a helically extending ball guiding groove 49.

Axial end portions 45*a* and 45*b* of ball screw shaft 45 are rotatably supported by first and second ball bearings 50 and 51 that are respectively received in a bottom part of circular opening 35*c* and a diametrically reduced right end of elongate receiving space 35*a*. First ball bearing 50 positioned near electric motor 36 is tightly received in the right position by means of a tightening nut 39, and second ball bearing 51 is press-fitted in the right position, as shown. If desired, first ball bearing 50 may be press-fitted in the right position without usage of tightening nut 39.

As is seen from FIG. 3, the left end portion 45*a* of ball screw shaft 45 and a right end portion of drive shaft 36*a* of electric motor 36 are axially movably connected by means of a cylindrical connector 52. That is, a serration connection is provided between the two end portions to transmit rotation of drive shaft 36*a* to ball screw shaft 45 while permitting a certain but small axial movement between the two end portions.

Ball nut member 46 is in the cylindrical form and has at an inner cylindrical surface thereof a helically extending ball guiding groove 53 that is incorporated with the above-mentioned helically extending ball guiding groove 49 of ball screw shaft 45 to define therebetween a plurality of ball holding helical spaces in which a plurality of balls 54 are operatively or rotatably received. Although not shown in the drawing, two deflectors are arranged in ball nut member 46 to form circulation rows of balls 54 at axially front and rear portions of ball nut member 46. That is, due to joint work of these two deflectors, the plurality of balls 54 rotatably moving in the above-mentioned ball holding helical spaces are forced to return to original circulation rows so that balls 54 circulate in the same work range. With these balls 54, rotation of ball screw shaft 45 about its axis induces a smoothed axial movement of ball nut member 46 on and along ball screw shaft 45.

That is, when ball screw shaft 45 is turned about its axis, ball nut member 46 is forced to move forward or backward along ball screw shaft 45 through balls 54.

As is seen from FIG. 1, ball nut member 46 has at diametrically opposed sides thereof respective pins 55 to which two arms of the forked lower end of link member 48 are pivotally connected.

As is seen from FIGS. 1 and 3, connecting arm 47 is generally L-shaped and has a base portion 47*a* integral with end 32*a* of control shaft 32. An arm portion 47*b* projected from base portion 47*a* has at axially opposed ends respective pins 56 to which two arms of the formed upper end of link member 48 are pivotally connected.

If desired, connecting arm 47 may not be integral with control shaft 32. That is, connecting arm 47 may be a separate member that is tightly connected to control shaft 32 by means of pins.

As is seen from FIG. 1, link member 48 is constructed by pressing a plate metal member, so that the pressed metal member has a generally U-shaped cross section. As shown, two parallel plate portions 57 and 57 provided by the pressed metal member serve as the above-mentioned two arms of the forked lower end of link member 48 as well as two arms of the forked upper end of link member 48. Two parallel plate portions 57 and 57 are connected by a bridge portion 58.

As is seen from FIG. 1, two parallel plate portions 57 and 57 are constructed to form a larger forked lower end and a smaller forked upper end. The larger forked lower end is pivotally connected to ball nut member 46 by means of two pins 55 and the smaller forked upper end is pivotally connected to connecting arm 47 by means of two pins 56 as has been described hereinabove. It is to be noted that pins 55 and 56 are tightly fitted to the associated members 46 and 47*b* by means of caulking.

Bridge portion 58 is rectangular in shape and has longitudinal both ends bent downward in the drawing (viz., FIG. 1) to constitute lower portions of the two arms of the forked upper end of link member 48. The inside area of link member 48 is denoted by numeral 59 in FIG. 3.

As is understood from FIG. 1, with the above-mentioned construction and arrangement, link member 48 is forced to incline in accordance with an axial movement of ball nut member 46.

As is seen from FIGS. 1 and 3, between one axial end of ball nut member 46 and a circular spring retainer 60 installed on an inside wall of first ball bearing 50, there is compressed a first coil spring 61 for biasing ball nut member 46 in a direction away from electric motor 36, that is, in a direction to cause control shaft 32 to assume the maximum valve lift position.

Furthermore, between a circular spring retainer 62 mounted on the axial other end of ball nut member 46 and a circular spring retainer 63 installed near second ball bearing 51, there is compressed a second coil spring 64 for biasing ball nut member 46 toward electric motor 36, that is, in a direction to cause control shaft 32 to assume the minimum valve lift position.

Each of first and second coil springs 61 and 64 is so sized as to assure respective contact of both ends of coil spring 61 (or 64) with spring retainer 60 and ball nut member 46 (or spring retainer 62 and spring retainer 63) even when spring 61 (or 64) assumes its maximum length. In other words, each of first and second coil springs 61 and 64 is constantly compressed in greater or lesser degree.

As will be described in detail hereinafter, due to opposing forces of first and second coil springs 61 and 64 and an after-mentioned control shaft torque, ball nut member 46 is forced to take a generally middle position (see FIG. 5) when electric motor 36 stops to operate.

It is to be noted that when ball nut member 46 takes the generally middle position, stopper member 34 (see FIG. 2) of the stopper means takes a middle position between first and second stopper faces 31*b* and 31*c* of stopper wall 31 and at the same time two intake valves 2 and 2 (see FIG. 1) take their middle valve lift degree defined between the maximum valve lift degree and the minimum valve lift degree. It is to be noted that the middle valve lift degree of two intake valves 2 and 2 assures a sufficient intake air and thus a sufficient engine torque even in a cold starting of the engine wherein the piston friction is high.

In the following, operation of actuation mechanism 6 will be described with the aid of the accompanying drawings.

When the engine is in a low rotation operation condition including idling condition, the control current from control unit 40 turns electric motor 36 in one direction. Upon this, ball screw shaft 45 is turned about its axis in one direction.

Due to turning of ball screw shaft 45, as is understood from FIG. 3, ball nut member 46 is forced to move leftward on and along ball screw shaft 45 permitting rotation of balls 54 in the ball holding helical spaces that are defined between the two ball guiding grooves 49 and 53.

With this, due to the work of link member 48 and connecting arm 47, control shaft 32 is forced to turn in a clockwise direction in FIG. 3. During this, as is seen from FIG. 2, stopper member 34 secured to control shaft 32 turns clockwise in the drawing bringing second stopper surface 34*d* thereof near to second stopper face 31*c* and finally induces a contact of these stopper surface 34*d* and stopper face 31*c*, as is seen from this drawing. Upon this, further turning of stopper member 34 and thus that of control shaft 32 in clockwise direction are suppressed.

Figure 6B:
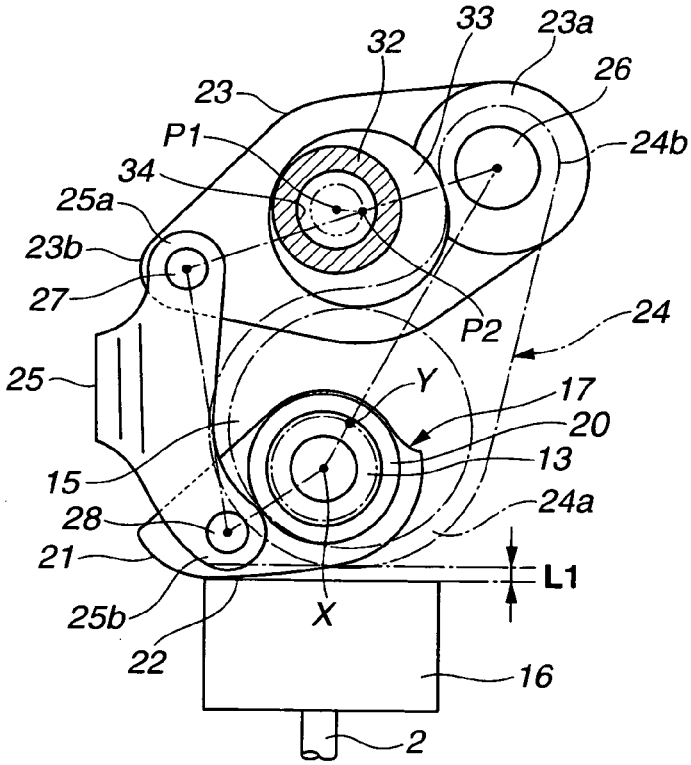

Accordingly, as is seen from FIG. 1, during the above-mentioned movement, control cam 33 is turned together with control shaft 32. That is, as is seen from FIGS. 6A and 6B, control cam 33 is turned counterclockwise causing the center "P2" thereof to turn counterclockwise about the axis "P1" of control shaft 32 and thus causing a thicker part thereof to move upward from drive shaft 13. Thus, the pivot point between end portion 23*b* of rocker arm 23 and link rod 25 is moved upward relative to drive shaft 13, and thus two swing cams 17 and 17 are turned in a clockwise direction while lifting respective nose parts 21 thereof upward.

Accordingly, when, due to rotation of drive cam 15, end portion 23*a* of rocker arm 23 is moved upward through link arm 24, a corresponding valve lift degree is transmitted to swing cam 17 and valve lifter 16 through link rod 25. More specifically, as is seen from FIG. 1, such valve lift degree is transmitted to two swing cams 17 and 17 and two valve lifters 16 and 16 because of the united connection between two swing cams 17 and 17. As is understood from FIG. 6B, the valve lift degree "L1" established in this condition is sufficiently small.

Figure 8:
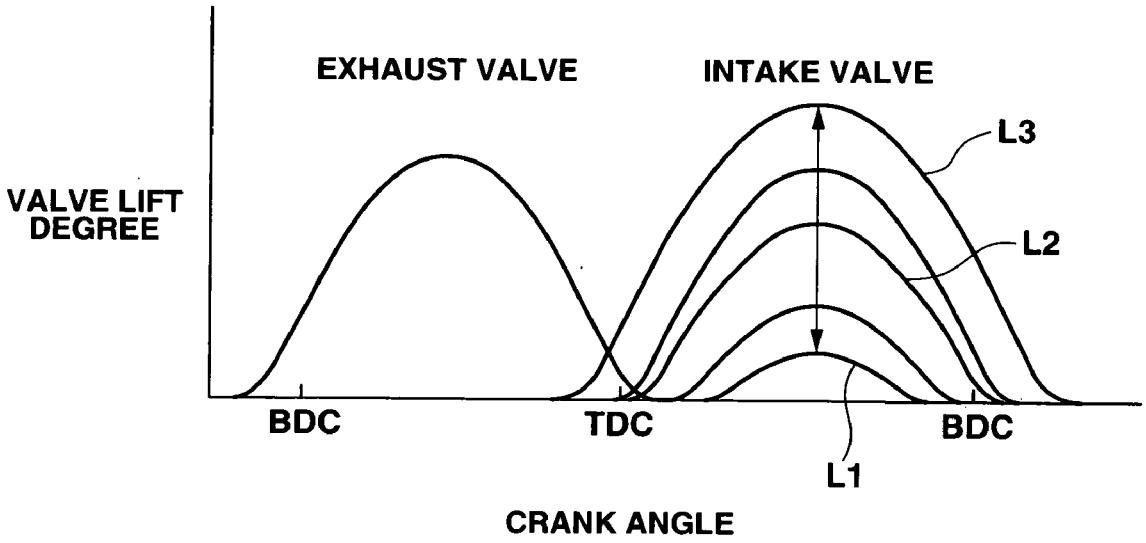
FIG. 8 is a graph showing a lift characteristic of an intake valve controlled by the variable valve mechanism of the first embodiment and that of an associated exhaust valve.

Accordingly, as is seen from the graph of FIG. 8, in such low rotation operation condition of the engine, the valve lift degree "L1" is very small inducing a retarded open timing of each intake valve 2 and reducing a valve overlapping zone with associated exhaust valves. Accordingly, reduction in fuel consumption and stable turning of the engine are obtained. If desired, control shaft 32 may take such a position that second stopper surface 34*d* (see FIG. 2) is slightly separated from second stopper face 31*c* causing the valve lift degree to be slightly higher than "L1". In this case, the valve lift degree can be much finely controlled. That is, in such case, a fine torque control is achieved without usage of throttling. In this case, the torque control responsibility is improved and fuel consumption is reduced.

When the engine is shifted to a high rotation operation condition, the control current from control unit 40 turns electric motor 36 in the other direction. Upon this, ball screw shaft 45 is turned in the other direction.

Due to turning of ball screw shaft 45, ball nut member 46 is forced to move rightward on and along ball screw shaft 45 from the position shown in FIG. 3 to the position shown in FIG. 4 permitting rotation of balls 54 in the ball holding helical spaces.

With this, due to the work of link member 48 and connecting arm 47, control shaft 32 is forced to turn in a counterclockwise direction in the drawings (FIGS. 3 and 4). During this, as is seen from FIG. 2, stopper member 34 secured to control shaft 32 turns counterclockwise in the drawing bringing first stopper surface 34*c* thereof near to first stopper face 31*b* and finally induces a contact of these two stopper surface 34*c* and stopper face 31*b*. Upon this, further turning of stopper member 34 and thus that of control shaft 32 in counterclockwise direction are suppressed.

Figure 7A:
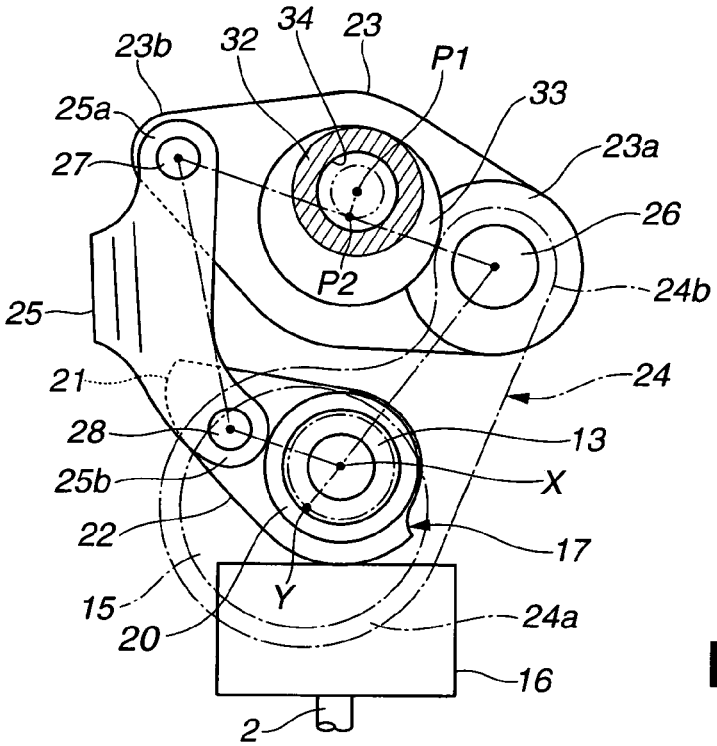
Figure 7B:
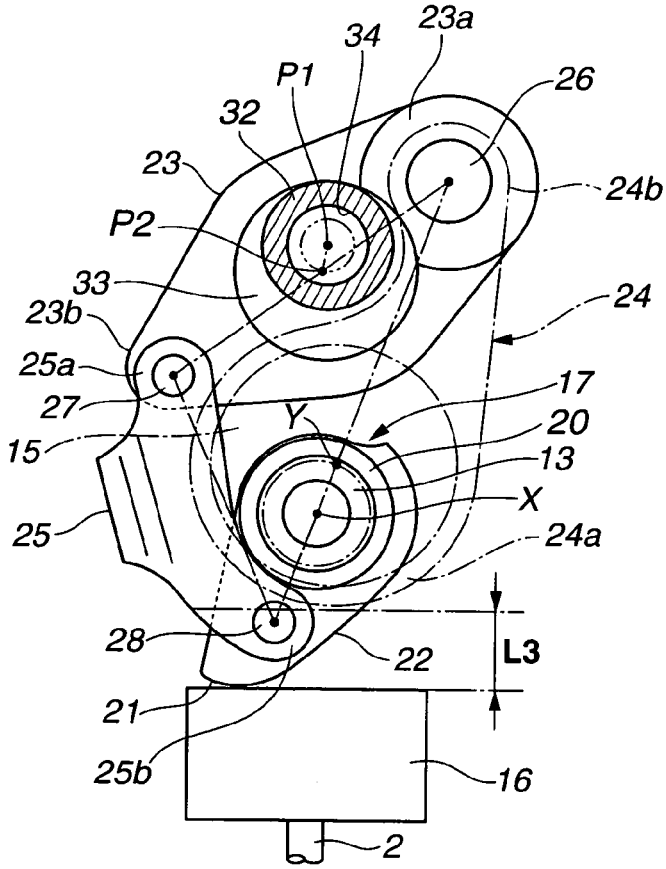

Accordingly, as is seen from FIG. 1, during the above-mentioned movement, control cam 33 is turned together with control shaft 32. That is, as is seen from FIGS. 7A and 7B, control cam 33 is turned clockwise causing the center "P2" thereof to turn clockwise about the axis "P1" of control shaft 32 and thus causing the thicker part thereof to move downward, that is, toward drive shaft 13. Thus, the pivot point between end portion 23*b* of rocker arm 23 and link rod 25 is moved toward drive shaft 13, and thus, two swing cams 17 and 17 are turned in a counterclockwise direction while moving nose parts 21 thereof downward.

Accordingly, when, due to rotation of drive cam 15, end portion 23*a* of rocker arm 23 is moved upward through link arm 24, a corresponding valve lift degree is transmitted to two swing cams 17 and 17 and two valve lifters through link rod 25. As is understood from FIG. 7B, the valve lift degree "L3" established in this condition is increased.

Accordingly, as is seen from the graph of FIG. 8, in such high rotation operation condition of the engine, the valve lift degree "L3" shows the maximum value inducing an advanced open timing of each intake valve 2 as well as a retarded close timing intake valve 2. Accordingly, intake air charging efficiency is increased and thus sufficient output power is produced by the engine.

In the following, with the aid of the graph of FIG. 9, a relation between a valve lift degree "L" of two intake valves 2 and 2 and average (or mean) torque "T" of control shaft 32 will be described.

The X-axis of the graph represents a rotation angle of control shaft 32. As the degree of rotation angle increases (viz., shifts rightward in the graph), control shaft 32 rotates in a clockwise direction in FIG. 1 as viewed from the direction of arrow "A". As is seen from the graph, as the point shifts rightward, the valve lift degree is increased. Furthermore, as is seen from the graph, when, due to the work of second stopper surface 34*d* and face 31*c* of the above-mentioned stopper means, control shaft 32 is suppressed from making further rotation in a direction to reduce the valve lift degree, control shaft 32 takes the rotation angle of "θmin" inducing the minimum valve lift degree "L1", while, when, due to the work of first stopper surface 34*c* and face 31*b* of the stopper means, control shaft 32 is suppressed from making further rotation in a direction to increase the valve lift degree, control shaft 32 takes the rotation angle of "θmax" inducing the maximum valve lift degree "L3".

Figure 9:
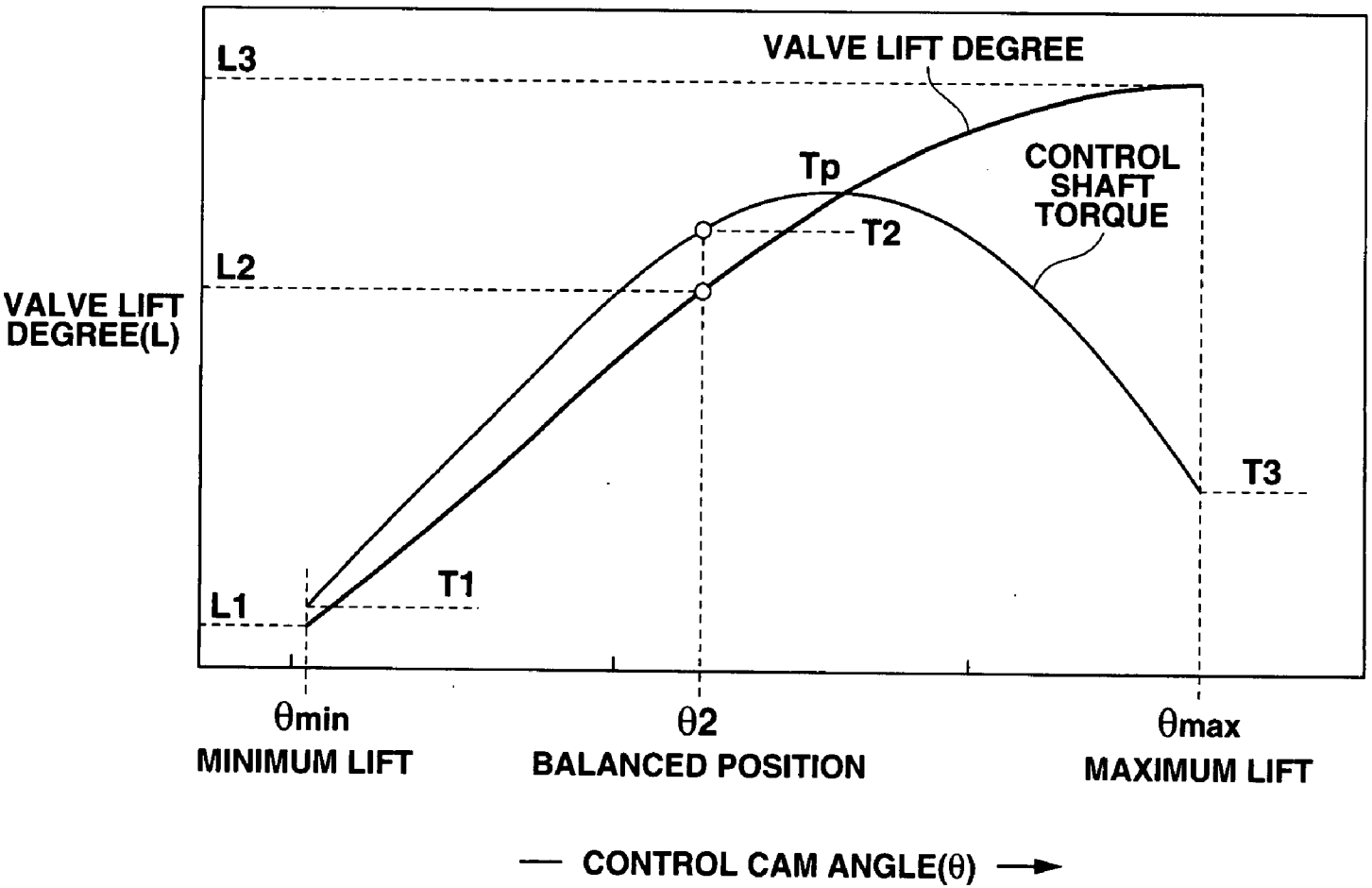
FIG. 9 is a graph depicting the performance of the first embodiment in terms of a relation among a turning angle of a control shaft, a valve lift degree and a torque of the control shaft.

The Y-axis of the graph of FIG. 9 represents an average torque applied to control shaft 32 when the engine is in an idling condition or in a very low rotation condition, such as in a cranking for starting the engine. In other words, the Y-axis shows an average torque applied to control shaft 32 when various parts of the engine are substantially free of inertia force. More specifically, the Y-axis shows a time related average torque applied to control shaft 32 during a time in which drive shaft 13, that turns with an angular velocity of half of that of a crankshaft, makes one turn.

Due to a spring load of valve springs 3 and 3 of intake valves 2 and 2, the average torque functions to reduce the rotation angle "θ" of control shaft 32, that is, to rotate control shaft 32 in a direction to reduce the valve lift degree. Thus, the average torque at the time of the minimum valve lift degree "L1" is very small "T1". The reason is as follows. That is, since the valve lift degree is small, the spring load applied to control shaft 32 from the valve springs 3 and 3 is small, and since the time for which the torque is applied to control shaft during a valve open period is short, the average torque applied to control shaft 32 during the time in which drive shaft 13 makes one turn becomes small.

As the rotation angle of control shaft 32 increases, the valve lift degree is increased and an operation angle of the valve is increased. Thus, the average torque of control shaft 32 is increased.

When the valve lift degree increases and finally exceeds a peak value "Tp", the average torque of control shaft 32 is reduced. This reason is as follows. That is, as is well understood from FIGS. 7A and 7B, the eccentric part of control cam 33 is shifted toward drive shaft 13, that is, in a direction in which control cam 33 is loaded by the spring force of valve springs 3 and 3, so that a moment (viz., the length of an arm section) that forces control cam 33 to rotate in a direction to reduce the valve lift degree is reduced. Accordingly, irrespective of increase of load due to increase in the valve lift degree, the torque applied to control shaft 32 is gradually reduced.

In the graph of FIG. 9, the control shaft torque appearing at a rotation angle "θ 2" of control shaft 32, that is located between the angle "θ min" and the angle "θ max", is represented by "T2".

As shown, the position of "T2" is near to "Tp" as compared with "θ min".

Figure 10:
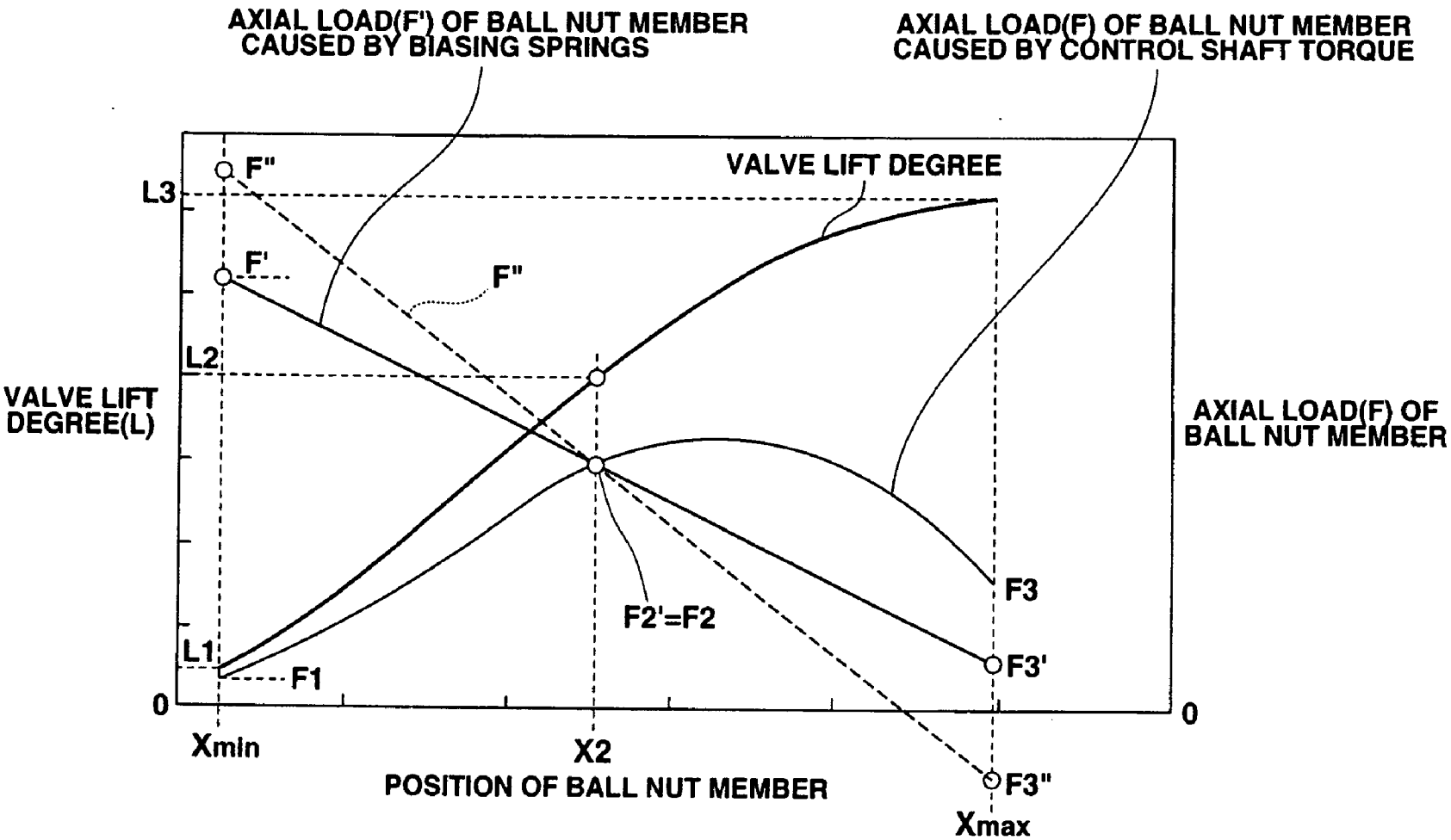
FIG. 10 is a graph depicting an axial load applied to the ball nut member with respect to the position of the ball nut member.

FIG. 10 is a graph showing a characteristic of the load applied to ball nut member 46. The X-axis represents the position that ball nut member 46 takes. In the graph, "Xmin" is the position for achieving the minimum valve lift degree "L1", which corresponds to the above-mentioned "θ min" and "Xmax" is the position for achieving the maximum valve lift degree "L3", which corresponds to the above-mentioned "θ max".

As has been mentioned hereinabove, ball nut member 46 is applied with an axial load "F" due to the control shaft torque in a direction to reduce the valve lift degree. If, for example, ball nut member 46 takes an intermediate position "X2" between the position "Xmin" and the position "Xmax", the rotation angle of control shaft 32 corresponds to the above-mentioned "θ 2".

The above explanation will be much clarified from the following description with the aid of FIG. 5.

In the condition depicted by this drawing (viz., FIG. 5), the rotation angle of control shaft is "θ 2", the position of ball nut member 46 is "X2", the valve lift degree is "L2" and the control shaft torque is "T2". That is, the control shaft torque "T2" is applied to control shaft 32 in a direction to reduce the valve lift degree and, due to the control shaft torque "T2", ball nut member 46 is biased leftward in the drawing, that is, due to the control shaft torque "T2", ball nut member 46 is applied with the axial load "F2" in a direction to reduce the valve lift degree. While, to ball nut member 46, there are also applied a biasing force "Fi" of first coil spring 61 in a direction to increase the valve lift degree and another biasing force "Fd" of second coil spring 64 in a direction to reduce the valve lift degree.

In the illustrated condition, biasing force "Fi" is larger than biasing force "Fd", and thus, the load applied to ball nut member 46 by the two coil springs 61 and 64 has a characteristic to increase the valve lift degree. That is, F' (=Fi−Fd) is greater than 0 (zero).

Now, the load applied to ball nut member 46 by the average torque of control shaft 32 has a characteristic to reduce the valve lift degree (that is, ball nut member 46 is biased leftward), the load "F'" applied to ball nut member 46 by both first and second coil springs 61 and 64 has a characteristic to increase the valve lift degree (that is, ball nut member 46 is biased rightward), and ball nut member 46 takes a certain position where the two loads are balanced.

In the graph of FIG. 10, the balanced position is denoted by "X2" and the valve lift degree at the balanced position is denoted by "L2".

In the graph, the range placed at the left side of point "X2" has the "F'" greater than "F". Thus, ball nut member 46 located in the left range is biased rightward, that is, in a direction to increase the valve lift degree. While, ball nut member 46 located in the right range is biased leftward, that is, in a direction to reduce the valve lift degree. Accordingly, ball nut member 46 tends to take its stable position at or near the point "X2". In this stable position of ball nut member 46, the load "F2'" that is the load "F'" at position "X2" and the load "F2" that is the load "F" at position "X2" are matched with each other.

When, with the engine kept in idling condition, an ignition key is turned to OFF position, the engine becomes stopped. In this case, electric motor 36 is de-energized, and thus, ball nut member 46 is forced to take the stable position "X2". If, due to engine stall or the like, ball nut member 46 takes a position other than the position "X2", ball nut member 46 is forced to move to the stable position "X2" upon cranking of a subsequent engine starting.

Accordingly, even if electric motor 36 fails to operate due to breaking down of feed wires or the like, ball nut member 46 is assuredly moved to the stable position "X2" at a subsequent engine starting. As has been mentioned hereinabove, the stable position "X2" is the position for inducing a certain valve lift degree "L2" that assures production of a certain torque overcoming a remarked piston friction even in a cold starting of the engine. That is, even in such undesired condition, starting of the engine and slow running of an associated motor vehicle become possible.

Since the valve lift degree "L2" induced by the stable position "X2" of ball nut member 46 is small as compared with the maximum valve lift degree "L3", friction of the valve operation parts is small and thus upon cranking at the time of subsequent engine starting, rotation of the crankshaft is smoothed and thus engine starting is easily carried out.

Referring back to the graph of FIG. 10, the axial load "F'" provided by two coil springs 61 and 64 in a direction to increase the valve lift degree is indicated by a thicker solid line. This thick solid line shows that when ball nut member 46 takes the position "Xmin", the axial load "F'" shows the maximum value "F1'", and when ball nut member 46 takes the position "Xmax", the axial load "F'" shows the minimum value "F3'".

While, the axial load "F" provided by the control shaft torque in a direction to reduce the valve lift degree is indicated by a thinner solid line (or curve).

It is now to be noted that an intersection point between the thicker solid line "F'" and the thinner solid line "F" is only one, that is, the point provided by the stable position "X2". Only at this point, a relation "F2'=F2" is established. This is important in the present invention.

As is seen from the graph of FIG. 10, the thinner solid curve for the axial load "F" is of a type that has at an upper part thereof a curved segment that extends downward. Thus, theoretically, the thicker solid line "F'" and the thinner solid line "F" should have two intersection points. This means that ball nut member 46 may have two stable positions. However, practically, it is difficult to provide both stable positions with the above-mentioned assured fail-safe function, and as a result, either one of the stable positions tends to induce undesirable matter, such as poor engine starting or the like.

In view of the above, in the invention, the thicker solid line "F'" provided has an inclination larger than a given inclination for the purpose of having only one intersection point with the thinner solid line "F". For this purpose, first and second coil springs 61 and 64 used in the present invention are of a type having a larger spring constant.

In the above-mentioned example, the thicker solid line "F'" is so arranged that even at the maximum valve lift degree position "Xmax", the biasing is made in a direction to increase the valve lift degree. However, if desired, as is shown by a broken line "F'", the direction of axial load applied to ball nut member 46 by two coil springs 61 and 64 may be reversed. This means that even when no control shaft torque is applied, there is a stable position of ball nut member 46 between the positions "Xmin" and "Xmax". In such case, in a range that induces a valve lift degree smaller than the degree "L2", that is, in the range placed at a left side of the position "X2", the biasing force in a direction of increasing the valve lift degree is increased. Furthermore, in a range that induces a valve lift degree larger than the degree "L2", that is, in the range placed at a right side of the position "X2", the biasing force in a direction of reducing the valve lift degree is increased. That is, the stability for the valve lift degree "L2" is much improved.

In the following, advantages of the present invention will be briefly described.

If electric motor 36 fails to operate due to breaking down of feed wires or the like, bal nut member 46 is assuredly moved to the stable position "X2" at a subsequent engine starting due to the work of two coil springs 61 and 64. The stable position "X2" of ball nut member 46 induces a certain valve lift degree "L2" that assures the subsequent engine starting. That is, a so-called fail-safe function is provided.

Since each of first and second coil springs 61 and 64 is constantly in contact with ball nut member 46 and retainer portion or member at axially opposed ends thereof irrespective of position that ball nut member 46 takes, undesired impact noise that would be produced in known mechanisms when the axial end of the ball nut member is brought into contact with one end of the coil spring is assuredly suppressed. Furthermore, undesired sudden change in load applied to ball nut member 46 due to the contact between the ball nut member 46 and the end of coil spring is assuredly suppressed. Accordingly, the precision of turning or controlling control shaft 32 is increased.

Since ball nut member 46 is constantly sandwiched or compressed by two coil springs 61 and 64, undesired play of ball nut member 46 in the axial direction is assuredly suppressed. This promotes the effect of reducing the noise.

Since ball nut member 46 is biased by two coil springs 61 and 64 to take the intermediate position "X2" that assures a normal operation of an associated engine, the energy for driving electric motor 36 during the time when the engine is under the normal operation is saved. Thus, fuel consumption of the engine is improved. Furthermore, since the responsibility of ball nut member 46 to an instruction to move the same to the intermediate position is improved by the two coil springs, acceleration performance just after engine starting is increased.

Figure 11:
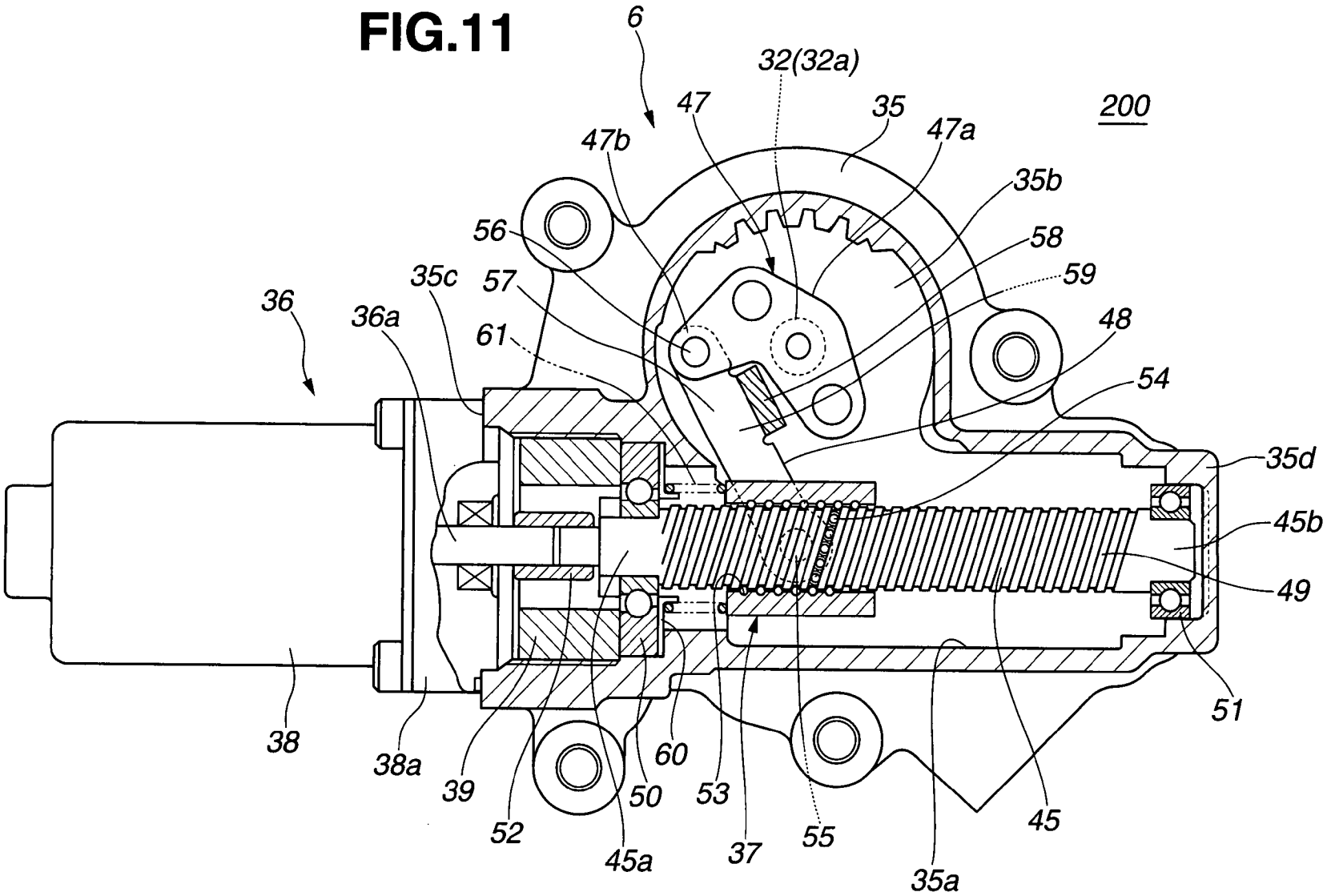
FIG. 11 is a partially cut view of an actuation mechanism employed in a second embodiment of the invention, showing that the actuation mechanism assumes a position to induce a minimum valve lift degree.
Figure 12:
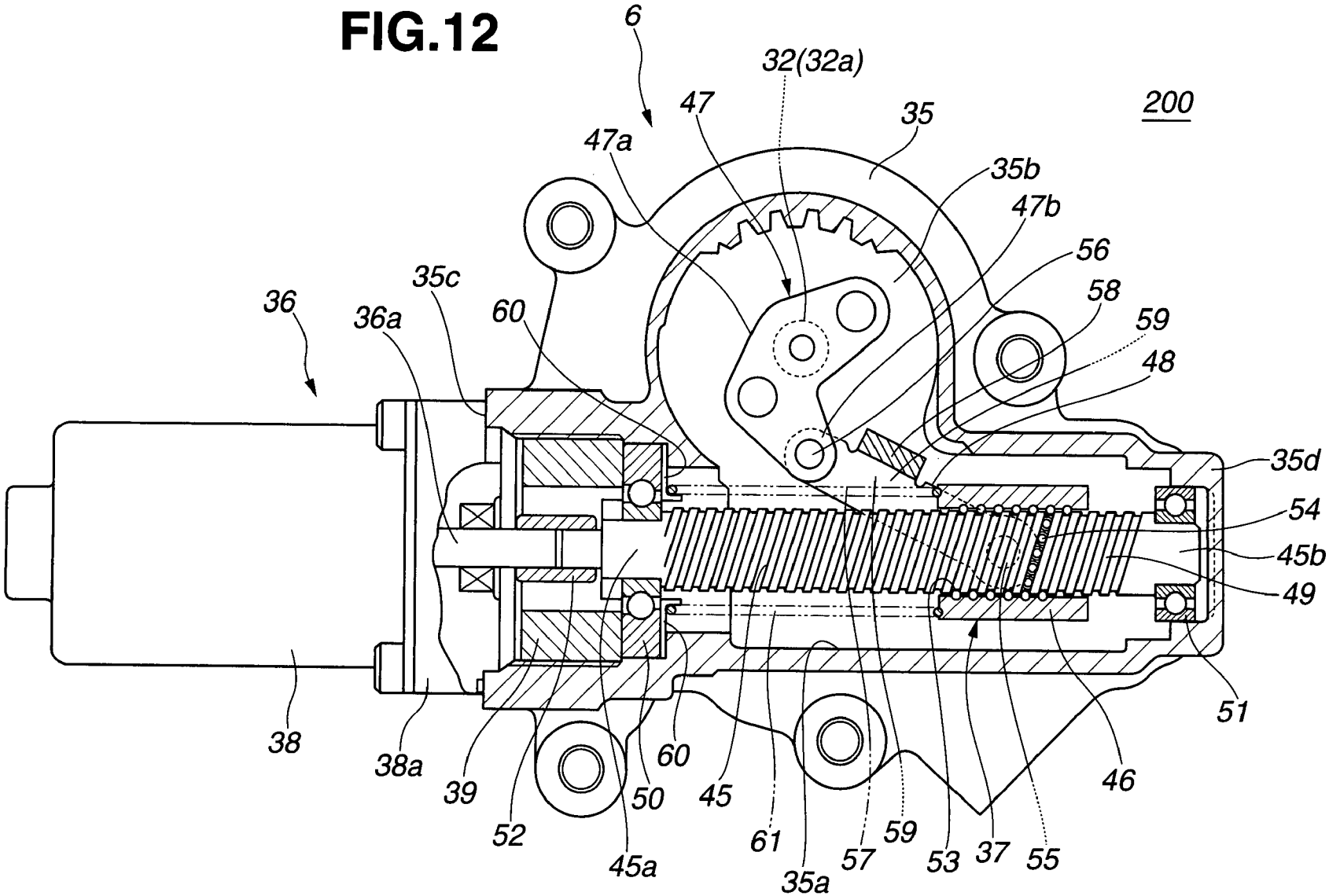
FIG. 12 is a view similar to FIG. 11, but showing that the actuation mechanism assumes a position to induce a maximum valve lift degree.
Figure 13:
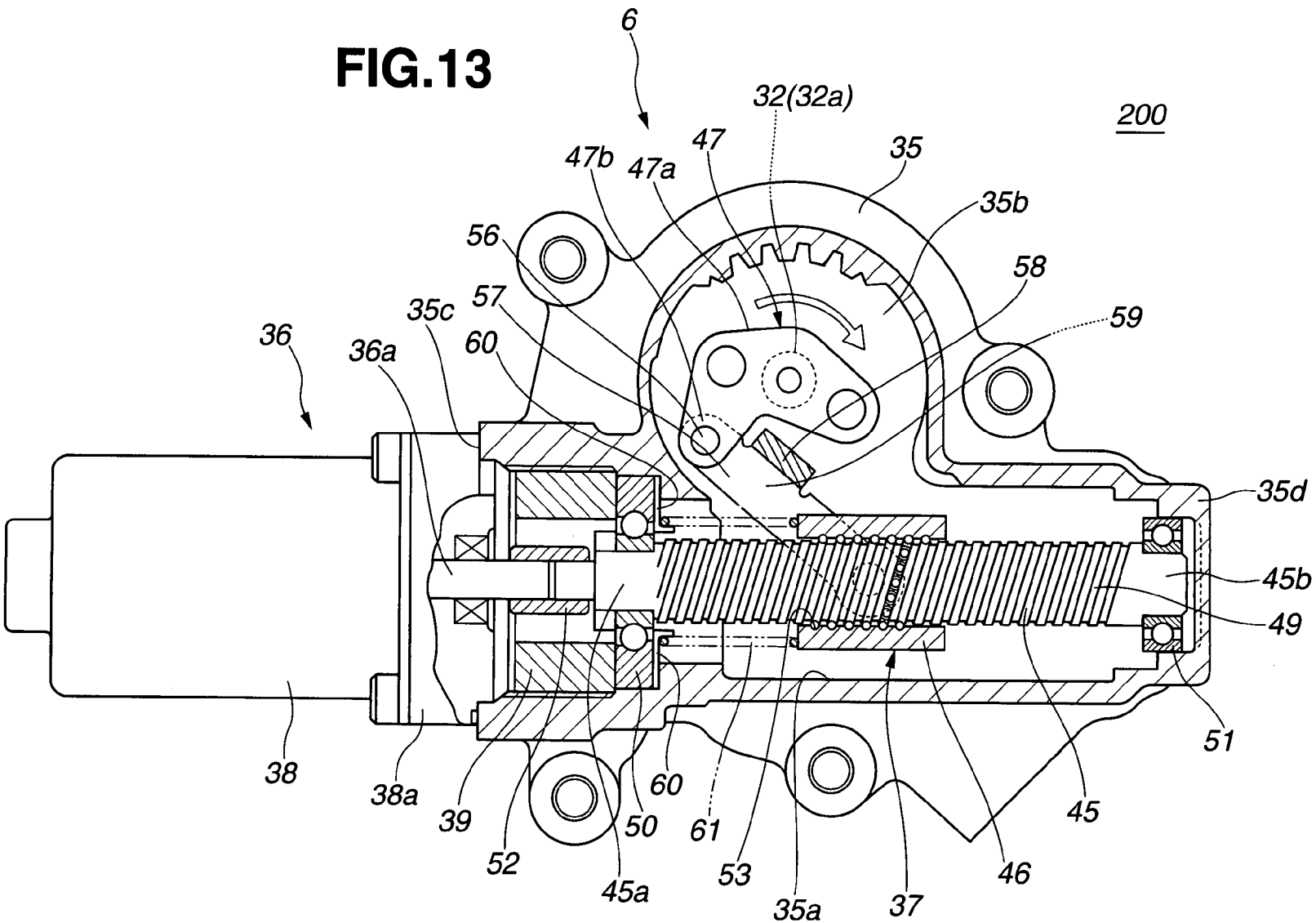
FIG. 13 is a view similar to FIG. 11, but showing that a ball nut member of the actuation mechanism assumes a middle position.

Referring to FIGS. 11 to 13, there is shown an actuation mechanism employed in a variable valve mechanism 200 of a second embodiment of the present invention.

As is understood from these drawings, in this second embodiment 200, there is no coil spring that corresponds to second coil spring 64 used in the above-mentioned first embodiment 100. That is, in this second embodiment 200, only one coil spring 61 is used. Also in this embodiment 200, coil spring 61 is sized and constructed to assure a constant contact of a leading end thereof with ball nut member 46 irrespective of position that ball nut member 46 takes.

Accordingly, like in the first embodiment 200, undesired impact noise and undesired sudden change of load of ball nut member 46 are suppressed. Accordingly, the control of the valve lift degree by the variable valve mechanism is improved.

In this second embodiment 200, ball nut member 46 is biased leftward in the drawing by the control shaft torque, that is, in a direction to reduce the valve lift degree, and biased rightward by coil spring 61, that is, in a direction to increase the valve lift degree. Accordingly, ball nut member 46 is stably held by both the biasing force of coil spring 61 and the control shaft toque, and thus, undesired play of ball nut member 46 in the axial direction and undesired impact noise are assuredly suppressed.

Figure 14:
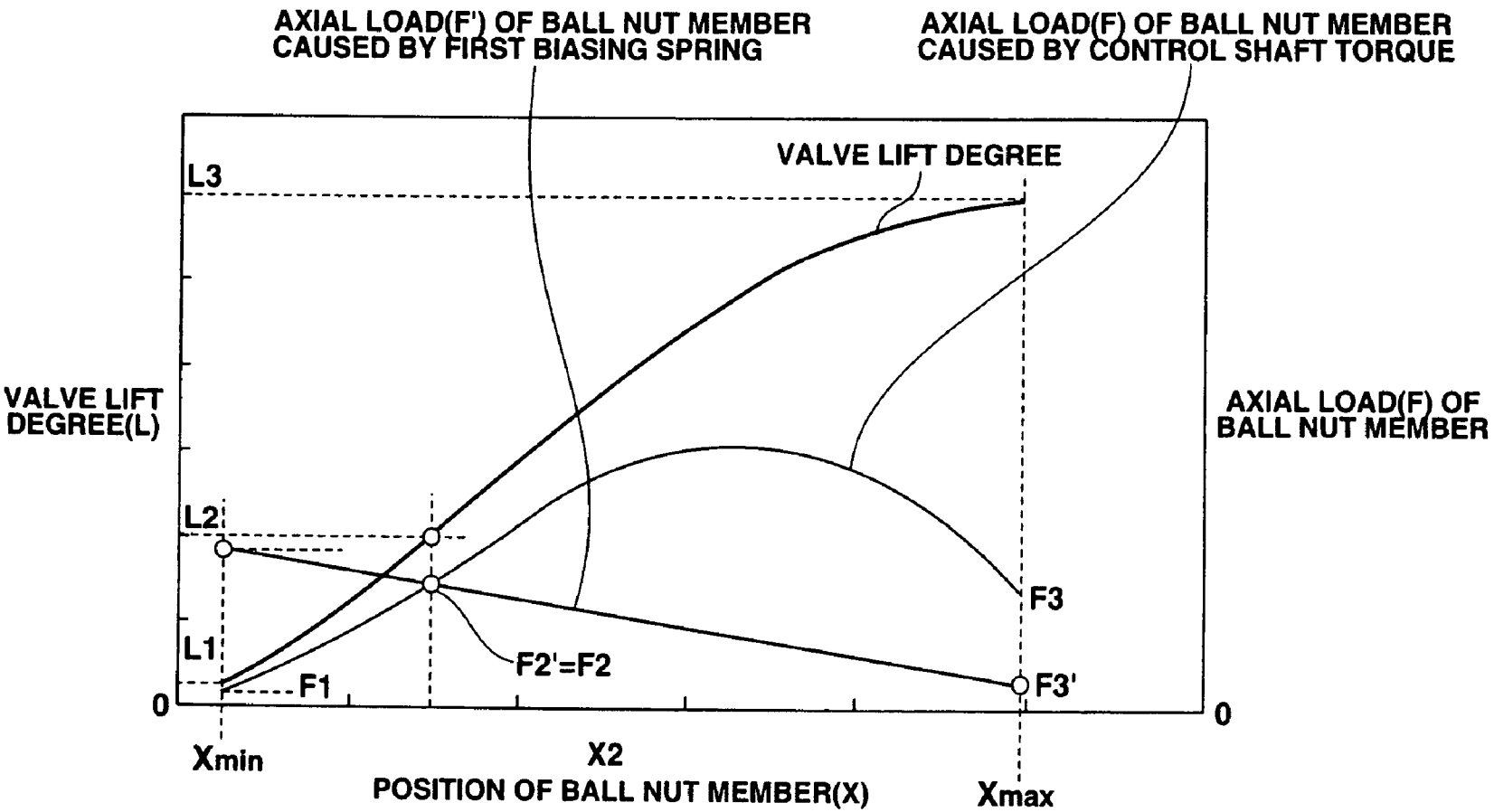
FIG. 14 is a graph depicting an axial load applied to the ball nut member with respect to the position of the ball nut member.

FIG. 14 is a graph showing a characteristic of the load applied to ball nut member 46 in case of the second embodiment 200. As will be understood when comparing this graph with the graph of FIG. 10, in case of the second embodiment 200, the valve lift degree is entirely a little smaller than that of the above-mentioned first embodiment 100. This valve lift reduction is easily realized by changing the position (or direction) of the eccentric part of control cam 33 tightly mounted on control shaft 32.

The minimum valve lift degree "L1" taken when ball nut member 46 takes the position "Xmin" is set at about 0.1 to 0.5 mm. In case of such a valve lift degree (viz., about 0.1 to 0.5 mm), warming-up idling operation of the engine is possible even when the throttle valve is almost closed, and thus, undesired pumping loss is reduced thereby improving the fuel consumption of the engine.

The valve lift degree "L2" taken when ball nut member 46 takes the position "X2" where the load "F'" provided by coil spring 61 and the control shaft torque are balanced is set at about 1 to 5 mm. This lift degree (viz., about 1 to 5 mm) assures not only the above-mentioned fail-safe function but also a regular speed operation of the engine including a high speed operation of the engine. Since ball nut member 46 is forced to take such a stable position "X2" as to assure the regular speed operation of the engine, the drive torque needed by electric motor 36 is reduced and thus power for operating the motor 35 is reduced. As a result, improved fuel consumption of the engine is realized.

As is seen from the graph of FIG. 14, the minimum valve "F3'" of the axial load "F'" taken when ball nut member 46 takes the position "Xmax" still has a positive value. This means that like the case of the first embodiment 100, the contact between coil spring 61 and ball nut member 46 is constantly kept.

Figure 15:
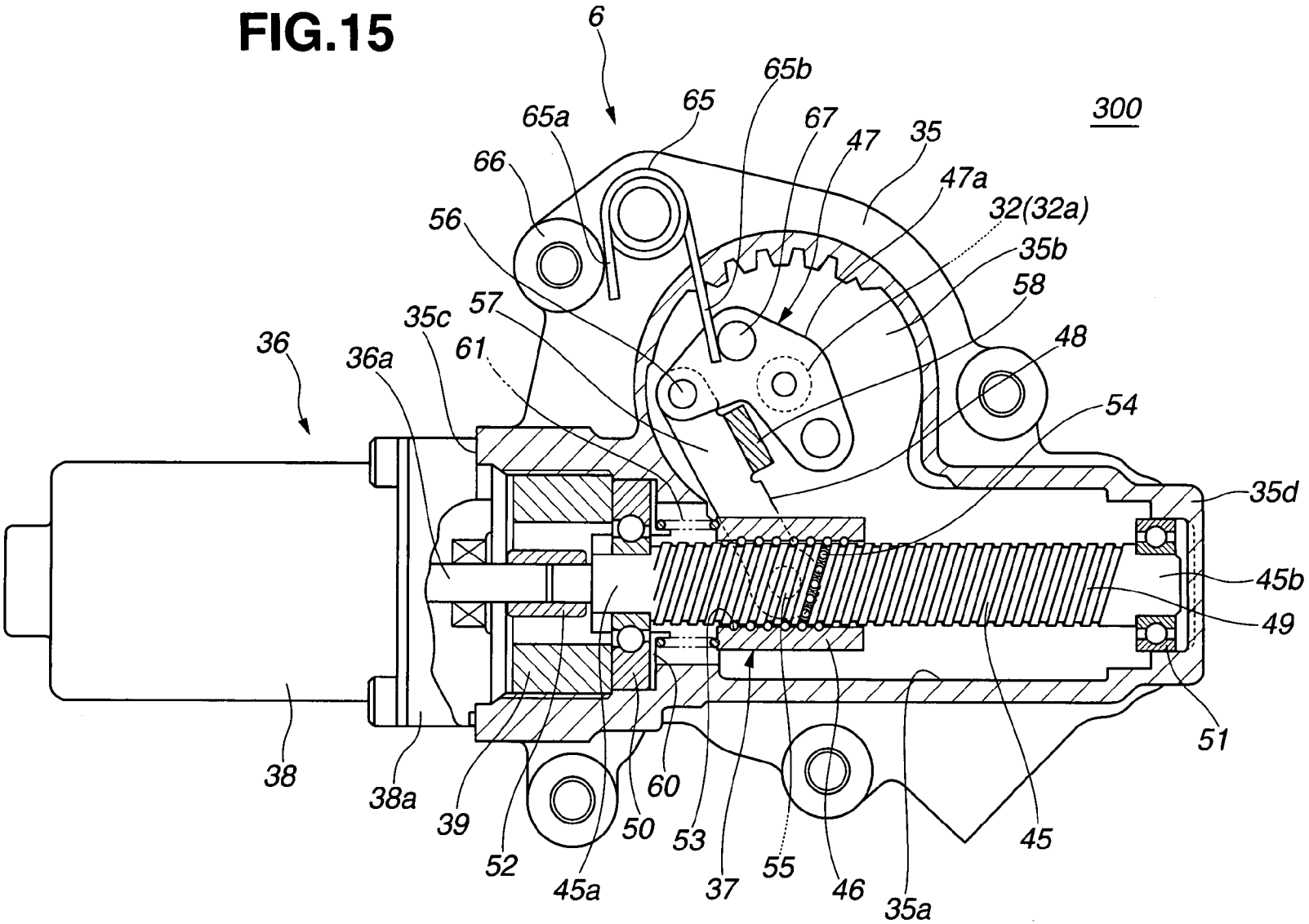
FIG. 15 is a partially cut view of an actuation mechanism employed in a third embodiment of the invention, showing that the actuation mechanism assumes a position to induce a minimum valve lift degree.

Referring to FIG. 15, there is shown an actuation mechanism employed in a variable valve mechanism 300 of a third embodiment of the present invention.

As is understood from the drawing, in this third embodiment 300, in place of second coil spring 64 used in the above-mentioned first embodiment 100, a return spring 65 is employed.

As shown, return spring 65 has one end 65*a* pressed against a boss portion 66 provided by an upper portion of housing 35 and the other end 65*b* pressed against a pin head 67 fixed to connecting arm 47. Due to the biasing force of return spring 65, control shaft 32 secured to connecting arm 47 is biased to turn clockwise in the drawing, that is, in a direction to reduce the valve lift degree. Like in the first embodiment 100, first coil spring 61 is employed as shown. For the reason as mentioned in the section of the first embodiment 100, return spring 65 functions to bias ball nut member 46 leftward and first coil spring 61 functions to bias ball nut member 46 rightward.

Accordingly, ball nut member 46 is stably held by both a combined biasing force of the biasing force of return spring 65 and the control shaft torque and the biasing force of first coil spring 61. Accordingly, like in the first embodiment, when electric motor 36 fails to operate, ball nut member 46 is assuredly moved to the stable position "X2" at a subsequent engine starting.

In the above-mentioned embodiments 100, 200 and 300, actuation mechanism 6 employs electric motor 36 as a motor. However, if desired, in place of such electric motor 36, a hydraulic motor may be used in the invention. Furthermore, the variable valve mechanism of the present invention may be applied to exhaust valves and/or both intake and exhaust valves of an internal combustion engine. Furthermore, since the present invention is applicable to variable valve mechanisms of a type in which the valve lift degree is continuously varied by turning a control shaft, the present invention is applicable to the variable valve mechanism disclosed in Japanese Laid-open Patent Applications (Tokkai) 2004-301058 and 2006-307765.

The entire contents of Japanese Patent Application 2007-046394 filed Feb. 27, 2007 are incorporated herein by reference.

Although the invention has been described above with reference to the embodiments of the invention, the invention is not limited to such embodiment as described above. Various modifications and variations of such embodiments may be carried out by those skilled in the art, in light of the above description.

What is claimed is:

1. A variable valve mechanism of an internal combustion engine, comprising:

a valve lift varying mechanism that varies a valve lift degree of an engine valve in accordance with a turning of a control shaft;

an actuation mechanism that controls the turning of the control shaft in accordance with an operation condition of the engine;

a first stopper structure that stops the turning of the control shaft when the control shaft turns to a first maximum stop position in a first direction to increase the valve lift degree;

a second stopper structure that stops the turning of the control shaft when the control shaft turns to a second maximum stop position in a second direction to reduce the valve lift degree; and a first biasing member that constantly biases the control shaft in the first direction, wherein, when the actuation mechanism fails to operate and thus fails to control the turning of the control shaft, the control shaft is turned to and held at an intermediate angular position between the first and second maximum stop positions by a biasing force that is produced by combining a biasing force of the first biasing member and a load that is applied to the control shaft in the second direction to reduce the valve lift degree, and wherein a curve representing a characteristic of load applied to the control shaft with respect to a controlled angular position of the control shaft and a line representing a characteristic of the biasing force of the first biasing member applied to the control shaft with respect to the controlled angular position of the control shaft are set to intersect each other at only one point.

2. A variable valve mechanism of an internal combustion engine as claimed in claim 1, wherein an average torque of the control shaft with respect to the controlled angular position of the control shaft increases as the valve lift degree changes in a direction from a minimum valve lift degree toward a maximum valve lift degree and decreases as the valve lift degree exceeds a certain peak degree defined between the minimum and maximum valve lift degrees.

3. A variable valve mechanism of an internal combustion engine as claimed in claim 1, wherein the first biasing member is a coil spring.

4. A variable valve mechanism of an internal combustion engine as claimed in claim 1, wherein a valve lift degree that induces a normal operation condition of the engine is set within a range between maximum and minimum valve lift degree inducing angular positions of the control shaft.

5. A variable valve mechanism of an internal combustion engine as claimed in claim 1, wherein a valve lift degree set within a range between maximum and minimum valve lift degree inducing angular positions of the control shaft is approximately 1 to 5 mm such that an open condition of the engine valve is induced.

6. An actuation mechanism for use with a valve lift varying mechanism of a variable valve mechanism of an internal combustion engine, the valve lift varying mechanism varying a valve lift degree of an engine valve when, in accordance with an operation condition of the engine, a control shaft is turned between a first stop position that stops a further turning of the control shaft in a direction to increase the valve lift degree and a second stop position that stops a further turning of the control shaft in a direction to reduce the valve lift degree, the actuation mechanism comprising:

a first biasing member that constantly biases the control shaft in the direction to increase the valve lift degree; and a second biasing member that constantly biases the control shaft in the direction to reduce the valve lift degree, wherein, upon starting of the engine, the control shaft is turned to and held at an intermediate angular position between maximum and minimum valve lift degree inducing angular positions by a biasing force that is produced by combining a biasing force of the first biasing member, a load applied to the control shaft in the direction to reduce the valve lift degree and a biasing force of the second biasing member, wherein a curve representing a characteristic of load applied to the control shaft with respect to a controlled angular position of the control shaft and a line representing a characteristic of a biasing force produced by combining the biasing forces of the first and second biasing members and applied to the control shaft with respect to the controlled angular position of the control shaft are set to intersect each other at only one point.

7. An actuation mechanism as claimed in claim 6, wherein the biasing force of the first biasing member is set to be greater than the biasing force of the second biasing member.

8. An actuation mechanism as claimed in claim 6, wherein an average torque of the control shaft with respect to the controlled angular position of the control shaft increases as the valve lift degree changes in a direction from a minimum valve lift degree toward a maximum valve lift degree and decreases as the valve lift degree exceeds a certain peak degree defined between the minimum and maximum valve lift degrees.

9. An actuation mechanism as claimed in claim 6, wherein the first biasing member is a coil spring.

10. An actuation mechanism as claimed in claim 6, wherein the second biasing member is a coil spring.

11. An actuation mechanism as claimed in claim 6, wherein the second biasing member is a return spring.

12. An actuation mechanism as claimed in claim 6, wherein a valve lift degree that induces a normal operation condition of the engine is set within a range between maximum and minimum valve lift degree inducing angular positions of the control shaft.

13. An actuation mechanism as claimed in claim 6, wherein a range between maximum and minimum valve lift degree inducing angular positions of the control shaft is approximately 1 to 5 mm at a time of valve opening.

14. An actuation mechanism as claimed in claim 6, further comprising:

an externally threaded output shaft;

an internally threaded moving member operatively engaged with the output shaft and moved axially when the output shaft is turned about an axis thereof; and a link mechanism that converts axial motion of the moving member to rotary motion of the control shaft.

* * * * *